US012578136B2

(12) United States Patent
Wainauski et al.

(10) Patent No.: US 12,578,136 B2
(45) Date of Patent: Mar. 17, 2026

(54) PIVOTABLE GUARD DEVICE FOR ICE BIN OF REFRIGERATION APPLIANCE

(71) Applicants: BSH Home Appliances Corporation, Irvine, CA (US); BSH Hausgeräte GmbH, Munich (DE)

(72) Inventors: Conner Wainauski, Knoxville, TN (US); Jorge Carlos Montalvo Sanchez, Knoxville, TN (US); Nilton Bertolini, Clinton, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 283 days.

(21) Appl. No.: 18/230,707

(22) Filed: Aug. 7, 2023

(65) Prior Publication Data

US 2025/0052474 A1 Feb. 13, 2025

(51) Int. Cl.
*F25C 5/20* (2018.01)

(52) U.S. Cl.
CPC ..... *F25C 5/22* (2018.01); *F25C 2400/04* (2013.01); *F25C 2400/10* (2013.01)

(58) Field of Classification Search
CPC .... F25C 5/22; F25C 2400/06; F25C 2400/10; F25C 5/24; F25D 25/025
See application file for complete search history.

(56) References Cited

U.S. PATENT DOCUMENTS

| | | | | |
|---|---|---|---|---|
| 1,670,959 | A | 5/1928 | Garrett | |
| 5,345,782 | A | 9/1994 | Takahashi et al. | |
| 6,401,478 | B2 | 6/2002 | Dasher et al. | |
| 7,739,879 | B2 | 6/2010 | Sellers et al. | |
| 9,194,622 | B2 | 11/2015 | Arslankiray et al. | |
| 9,335,083 | B2 | 5/2016 | Tafoya et al. | |
| 9,625,200 | B2 | 4/2017 | Gu et al. | |
| 10,094,608 | B2 | 10/2018 | Ouzts | |
| 11,204,194 | B2 | 12/2021 | Kim et al. | |
| 11,480,375 | B2 | 10/2022 | Kim et al. | |
| 11,480,377 | B2 | 10/2022 | Kim et al. | |
| 11,566,829 | B2 | 1/2023 | Kim et al. | |
| 2006/0005565 | A1 | 1/2006 | Roth et al. | |
| 2011/0314860 | A1* | 12/2011 | Tafoya | F25C 5/182 62/344 |
| 2023/0018118 | A1 | 1/2023 | Kim et al. | |
| 2024/0019188 | A1* | 1/2024 | Roth | F25C 5/20 |

* cited by examiner

*Primary Examiner* — Elizabeth J Martin
(74) *Attorney, Agent, or Firm* — Michael E. Tschupp; Andre Pallapies; Brandon G. Braun

(57) ABSTRACT

A pivotable ice bin guard device for preventing ice cubes from being inadvertently ejected from the back of an ice storage bin of a refrigeration appliance, such as over a rear wall of the ice storage bin. The ice maker guard device can include at least one hanger component that is mountable to the refrigeration appliance, such as in a freezer space thereof. A guard component is pivotably coupled to the at least one hanger component so as to be suspended from the hanger component above the ice storage bin. The guard component can also be located to engage the rear wall or other portion of the ice storage bin when the ice storage bin is in an extended position relative to the refrigeration appliance.

18 Claims, 11 Drawing Sheets

PIVOTABLE GUARD DEVICE FOR ICE BIN OF REFRIGERATION APPLIANCE

TECHNICAL FIELD

The present disclosure relates generally to refrigeration appliances and, more particularly (although not necessarily exclusively), to a guard device for preventing inadvertent ejection of ice cubes from an ice storage bin of a refrigeration appliance.

BACKGROUND

Refrigeration appliances, including combination refrigerator-freezer appliances and freezer-only refrigeration appliances, frequently include one or more ice storage bins for retaining ice cubes that are produced in ice cube trays, by another device, or by an automatic ice maker of the refrigeration appliance. A scoop or another suitable implement is then employed by a user to remove ice cubes from the storage bin(s) as needed.

An ice cube storage bin may be located in a drawer that is extendable and retractable relative to a freezer space of a refrigeration appliance, or may itself be an extendable ice storage bin that is extendable and retractable relative to a freezer space of a refrigeration appliance, so as to facilitate access to and removal of ice cubes retained in the ice storage bin. Likewise, an ice storage bin may be located in a fixed position above an extendable drawer of a refrigeration appliance. Unfortunately, it is quite common for one or more ice cubes to be inadvertently ejected from a storage bin during attempted removal with a scoop or otherwise. This can be problematic, especially when the ice cube(s) is ejected from a rear portion of the storage bin, as the ejected ice cube(s) can pass into an area of the refrigeration appliance where the ice cube(s) may thereafter prevent or inhibit closing or opening of a drawer within which the storage bin resides, another drawer below the storage bin, or the storage bin itself. It is also common, at least in the case of a refrigeration appliance with an automatic ice maker, for ice cubes to form a pile within an ice storage bin on occasions where the ice storage bin or a drawer within which the ice storage bin resides has not been opened for an extended period of time. Piled ice cubes can contribute to an unintended ejection of ice cubes from the storage bin, and may also hinder closure of the ice storage bin or drawer due to contact between the piled ice cubes and overhead (e.g., ice maker) components of the refrigeration appliance.

DETAILED DESCRIPTION

Figure 1:
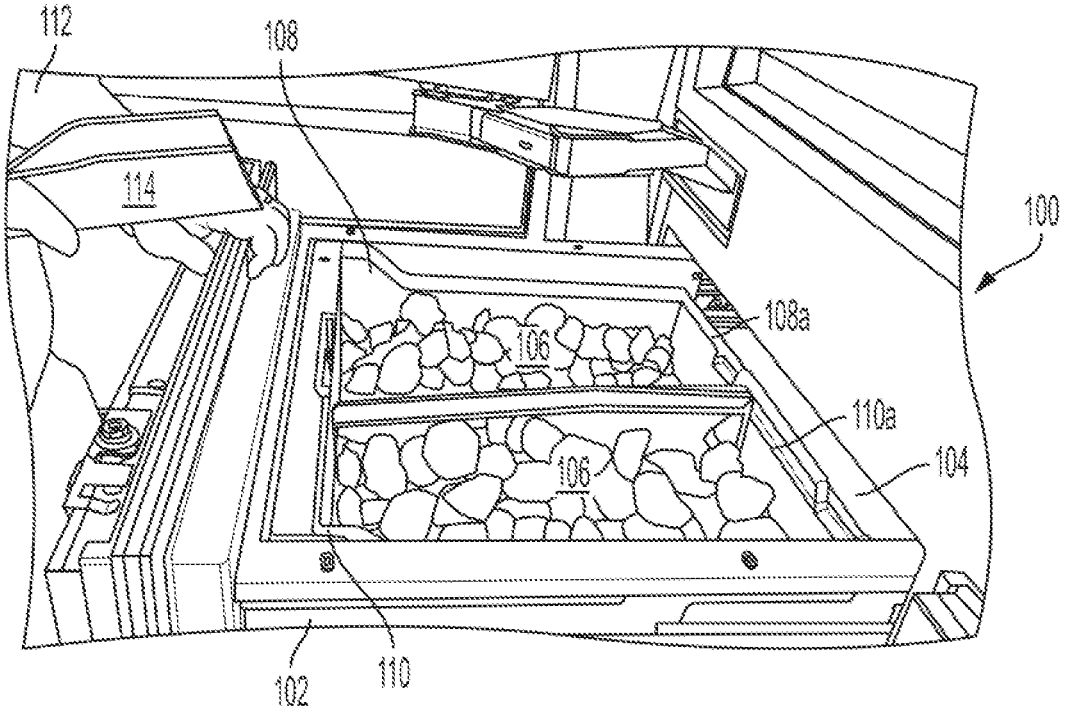
FIG. 1 depicts an extended ice drawer of a refrigeration appliance according to one example of the present disclosure.

Certain aspects and examples of the present disclosure relate to the retention of ice cubes within an ice storage bin of a refrigeration appliance, which may be an ice-making refrigeration appliance having an automatic ice maker. More specifically, aspects and examples of the present disclosure are directed to a pivotable ice bin guard device that is installable to a refrigeration appliance to prevent ice cubes from being inadvertently ejected from the back of an ice storage bin thereof, such as may occur when ice cubes are being scooped from the ice storage bin by a user. Examples of a pivotable ice bin guard device according to the present disclosure may also operate to rake piled ice cubes toward the front of an ice storage bin to which the pivotable ice bin guard device is installed when the ice storage bin or a drawer within which the ice storage bin resides is moved from an extended (open) position to a retracted (closed) position.

Preventing ice cubes from being inadvertently ejected from the back of at least one ice storage bin of a refrigeration appliance can be accomplished by providing a pivotable ice bin guard device having a guard component that is pivotably suspended from a hanger component at a location above the ice storage bin. The guard component can also be located to engage with a rear wall or other portion of the ice storage bin when the ice storage bin is in an extended position relative to the refrigeration appliance, and to block what would otherwise be an open space above a top edge of the rear wall of the ice storage bin. In this manner, the guard component forms a barrier to prevent ice cubes from being ejected over the rear wall of the at least one ice storage bin when the ice storage bin is in the extended position, which also prevents ice cubes from undesirably gathering in a location within the refrigeration appliance that is behind the ice storage bin (or drawer containing the ice storage bin).

The guard component of the pivotable ice bin guard device is preferably able to pivot forward and backward relative to the refrigeration appliance, and upward and downward relative to ice cubes in the ice storage bin, during extension of the ice storage bin from and return of the ice storage bin into the freezer space of the refrigeration appliance. For example, a guard component of a pivotable ice bin guard device example may pivot forward, upward and over piled ice cubes during the process of extending the ice storage bin from the refrigeration appliance so as to avoid displacing ice cubes toward the rear of the ice storage bin. A forward-angled lower portion of a guard component of a pivotable ice bin guard device example may rake ice cubes toward the front of an ice storage bin during the process of retracting the ice storage bin into the refrigeration appliance from an extended position so as to eliminate ice cube piling.

A pivotable ice bin guard device according to examples of the present disclosure is useable to provide ice cube retention in both refrigeration appliances and ice-making refrigeration appliances. As used herein, a refrigeration appliance refers to a refrigeration appliance having a freezer space within which resides at least one ice storage bin where ice cubes may be stored for subsequent use. The ice cubes may be produced by another appliance or in trays located in the freezer space, and may be manually transferred to the at least one ice storage bin. As used herein, an ice-making refrigeration appliance refers to a refrigeration appliance having a freezer space within which resides at least one ice storage bin where ice cubes may be stored for subsequent use, as well as an automatic ice maker having an ice cube producing component that overlies the at least one ice storage bin when the drawer is in the retracted position and produces ice cubes that are repeatedly deposited into the at least one ice storage bin. In any case, the at least one ice storage bin is either directly extendable from and retractable into the freezer space, or resides in and moves with a drawer that is extendable from and retractable into the freezer space. the guard component forms a barrier to prevent ice cubes from being ejected over the rear wall of the at least one ice storage bin when the drawer is in the extended position.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 depicts one example of an ice-making refrigeration appliance 100 that includes a slidable drawer 102 that is extendable from and retractable into a freezer space 104 of the ice-making refrigeration appliance. As shown, ice cubes 106 produced by the ice-making refrigeration appliance 100 are stored in first and second ice storage bins 108, 110 that reside in and move with the drawer 102. As represented, a user 112 can use an implement, such as a scoop 114, to remove ice cubes from one or both of the ice storage bins, 108, 110 as needed.

Figure 2:
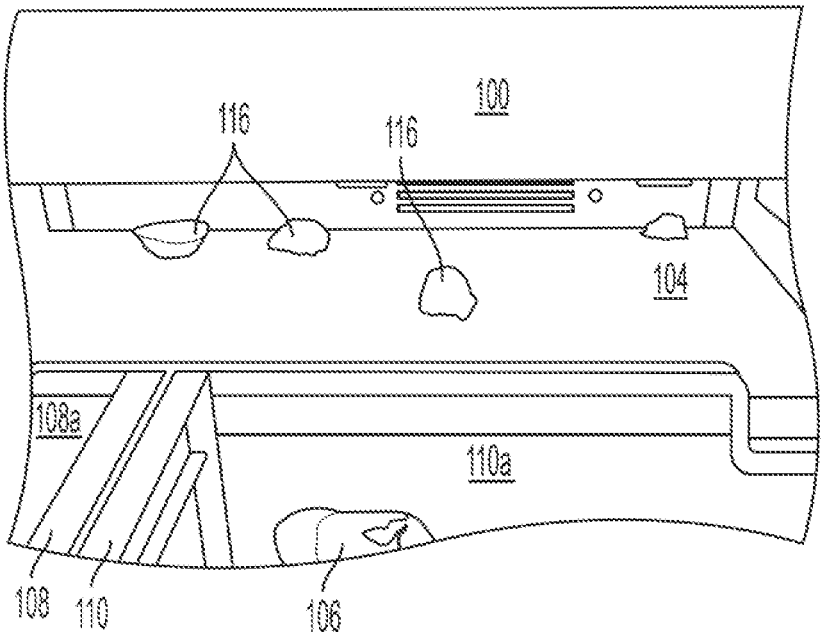
FIG. 2 shows several ice cubes that have been ejected from an ice cube storage bin into an area behind an ice drawer of a refrigeration appliance according to one example of the present disclosure.

As may be observed in FIG. 1, an open space exists above a rear wall 108*a*, 110*a* of each of the ice storage bins 108, 110. Consequently, it should be apparent that when the user 112 drives the scoop 114 toward the rear wall 108*a* of the first (left) ice storage bin 108 or the rear wall 110*a* of the second (right) ice storage bin 110 while scooping ice cubes, it is highly possible that one or more ice cubes may be ejected over the rear wall 108*a*, 110*a* of the respective first or second ice storage bin 108, 110. As shown in FIG. 2, ice cubes 116 that have been ejected over the rear wall 108*a*, 110*a* of one or both of the first or second ice storage bins 108, 110 may come to rest near a rear wall (or otherwise) in the freezer space 104 of the ice-making refrigeration appliance 100 such that the ejected ice cubes 116 reside behind the drawer 102. As a result, the ejected ice cubes 116 may prevent or inhibit retraction of the drawer 102 into the freezer space 104.

Figure 3:
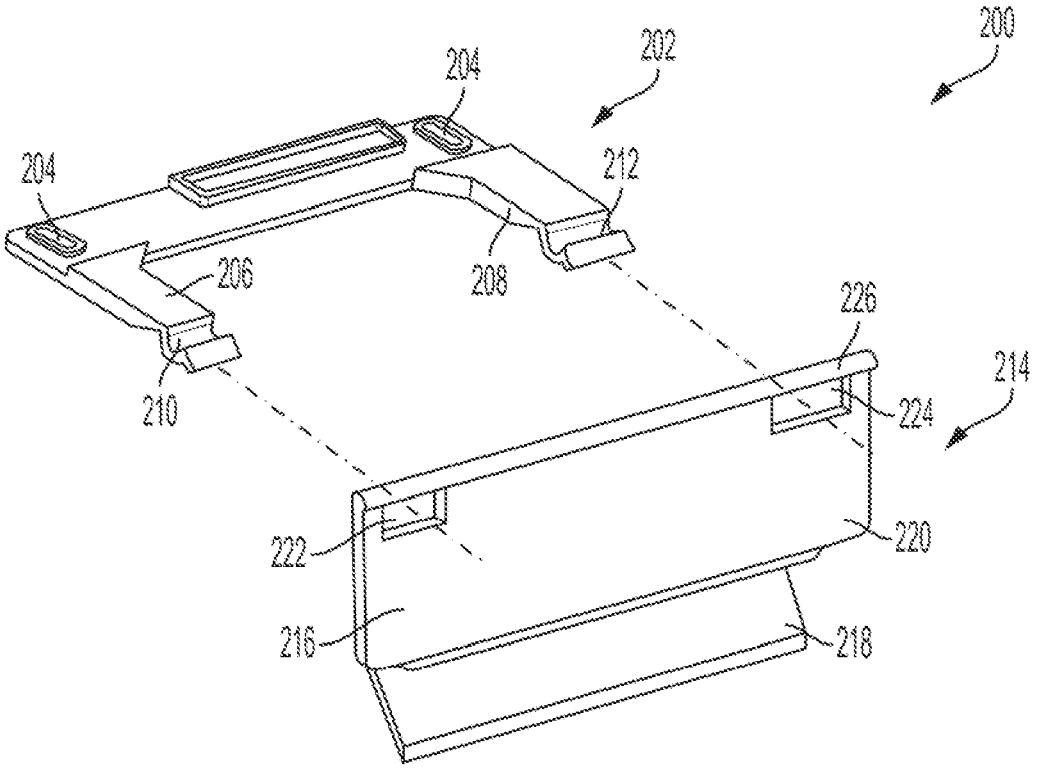
FIG. 3 is an exploded view depicting one example of a pivotable ice bin guard device according to the present disclosure.

FIG. 3 is a perspective view of one example of a pivotable ice bin guard device 200 according to the present disclosure. Associated FIG. 4 and FIGS. 5A-5C present various components for assembling different variations of the pivotable ice bin guard device 200 of FIG. 3

As shown in FIG. 3, the pivotable ice bin guard device 200 includes a hanger component 202 and a guard component 214. The hanger component 202 is designed for mounting to a structure of a refrigeration appliance or an ice-making refrigeration appliance, such as for example, the ice-making refrigeration appliance 100 of FIGS. 1-2. In some examples, the hanger component 202 can be mounted to an upper wall of a freezer space within a refrigeration appliance or an ice-making refrigeration appliance, a horizontally-oriented frame section of a refrigeration appliance or an ice-making refrigeration appliance, etc.

This example of the hanger component 202 is a substantially flat and substantially C-shaped element, but may be of somewhat different design in other examples based on, for example, the particular refrigeration appliance or ice-making refrigeration appliance with which it will be used. The hanger component 202 can be seen to include a body that includes a plurality (in this example) of mounting holes 204 for allowing threaded fasteners to pass through the hanger component 202 and into receiving holes in a refrigeration appliance or an ice-making refrigeration appliance. This example of the hanger component 202 also includes a pair of forward-extending hooked arms 206, 208 from which the guard component 214 can be pivotably suspended. The forward-extending hooked arms 206, 208 may be of the same dimension or of different dimensions (e.g., widths). The hooked-ends of the forward-extending hooked arms 206, 208 of the hanger component 202 may respectively include a groove 210, 212 that can facilitate pivoting of the guard component 214 relative to the hanger component 202 in some examples, as described in more detail below.

The hanger component 202 can be manufactured from various materials, including without limitation, metal and plastic. In this example, the hanger component 202 is a molded plastic component.

The guard component 214 is designed to be pivotably suspended from the hanger component 202, particularly from the forward-extending hooked arms 206, 208 of the hanger component 202 in this example. The hanger component 202 may include an upper portion 216 in the form of a substantially flat plate, and an ice-raking lower portion 218 that extends forward and downward relative to a front face 220 of the upper portion 216. For example, and without limitation, the lower portion 218 of the guard component 214 may extend forward and downward at an obtuse angle relative to the front face 220 of the upper portion 216, as shown in FIG. 3. The forward-angled nature of the lower portion 218 of the guard component 214 lends itself to a forward raking of piled ice cubes by the guard component 214 when an ice storage bin to which the pivotable ice bin guard device 200 is installed is retracted into the refrigeration appliance from an extended position.

The guard component 214 is further shown to include a pair of slots 222, 224 that pass through the upper portion 216 of the guard component 214. The slots 222, 224 in the guard component 214 are dimensioned and arranged to be aligned with and receive respective ones of the hooked-ends of the forward-extending hooked arms 206, 208 of the hanger component 202, as shown. When the hanger component 202 is secured to a surface, etc., of a refrigeration appliance or an ice-making refrigeration appliance as described above, and the hooked-ends of the forward-extending hooked arms 206, 208 of the hanger component 202 are engaged with the slots 222, 224 in the guard component 214, the guard component 214 is pivotably suspended from the hanger component 202.

To further facilitate the pivoting ability of the guard component 214 relative to the hanger component 202, the guard component 214 may additionally include an elongate cylindrical pivot element 226 along a top edge thereof, and the hanger component 202 may include the aforementioned grooves 210, 212 in respective ones of the forward-extending hooked arms 206, 208. When the elongate cylindrical pivot element 226 is present and the guard component 214 is engaged with the hanger component 202 as described above, the guard component 214 is pivotably suspended from the hanger component 202 by engagement of the elongate cylindrical pivot element 226 with the corresponding grooves 210, 212 in the forward-extending hooked arms 206, 208 of the hanger component 202.

Like the hanger component 202, the guard component 214 can be manufactured from various materials, including without limitation, metal and plastic. In this example, the guard component 214 is a molded plastic component.

Figure 4:
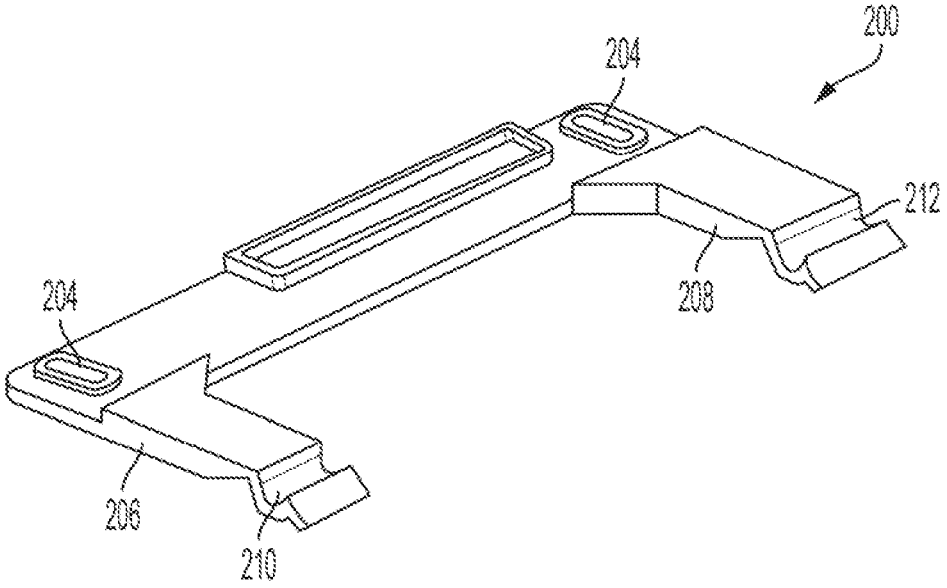
FIG. 4 is a perspective view of a hanger component of a pivotable ice bin guard device according to one example of the present disclosure.
Figure 5A:
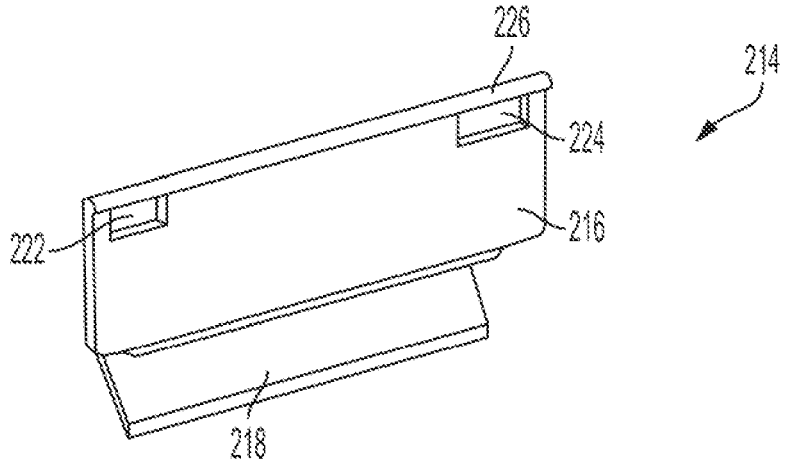
FIGS. 5A-5C each present a perspective view of a guard component for a pivotable ice bin guard device according to different examples of the present disclosure.
Figure 5B:
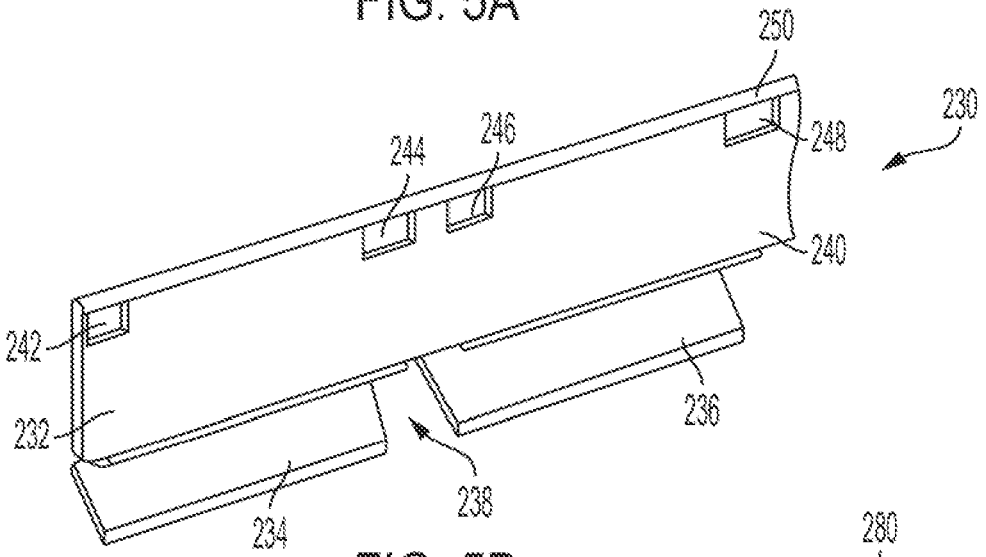
Figure 5C:
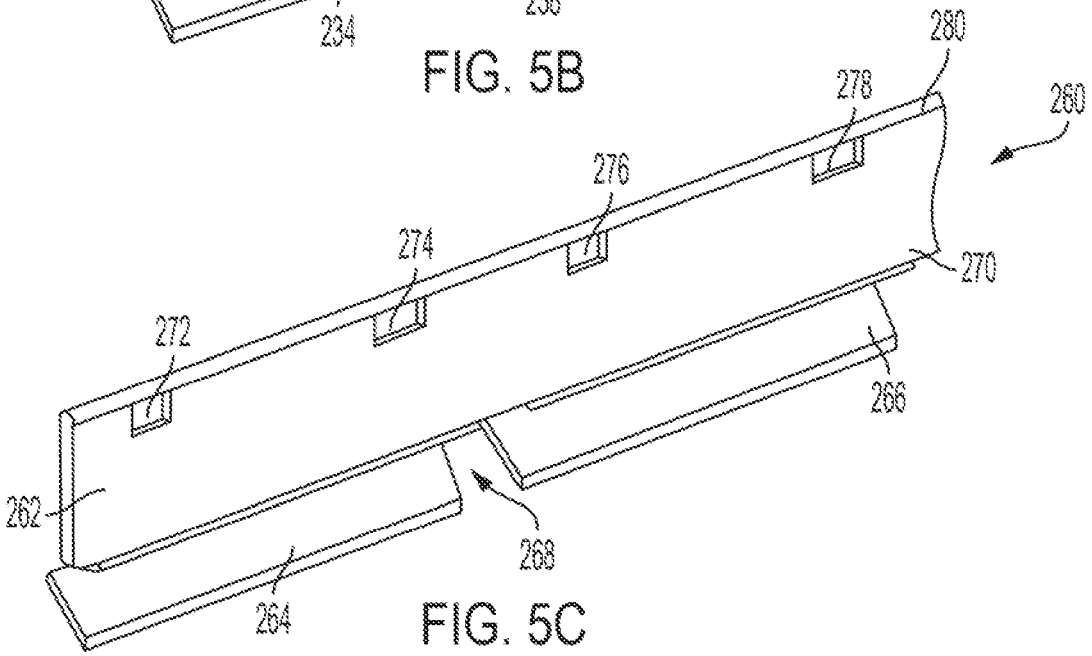

For purposes of further illustration, an enlarged view of the hanger component 202 example of FIG. 3 is presented alone in FIG. 4, and the guard component 214 is depicted separately from the guard component 214 in FIG. 5A. FIGS. 5B and 5C presents two additional examples of guard components that can be used in combination with multiple hanger components 202 to create pivotable ice bin guard devices for larger ice storage bins or situations where more than one ice storage bin is present.

FIG. 5B depicts an example of a guard component 230 that is larger than the guard component 214 shown in FIG. 3 and in FIG. 5A. The guard component 230 is intended for use with an ice storage bin that is larger than an ice storage bin with which the guard component 214 would be used, or with a refrigeration appliance or an ice-making refrigeration appliance that includes two ice storage bins of substantially equal width arranged side-by-side. For example, the guard component 230 may be used in conjunction with a refrigeration appliance or an ice-making refrigeration appliance of a standard 42 inch width.

The guard component 230 may include an upper portion 232 in the form of a substantially flat plate. In this example, a first ice-raking lower portion 234 and a second ice-raking lower portion 236 are separated by a slot 238 and extend forward and downward relative to a front face 240 of the upper portion 232 in a like or similar manner described above relative to the guard component 214.

This example of the guard component 230 includes four slots, 242, 244, 246, 248 that pass through the upper portion 232 of the guard component 230, versus the pair of slots 222, 224 in the guard component 230 of FIG. 3 and FIG. 5A. The slots 242, 244 form a first slot pair, with each slot 242, 244 dimensioned and arranged to be aligned with and receive respective ones of the hooked-ends of the forward-extending hooked arms 206, 208 of a first hanger component 202. The slots 246, 248 form a second slot pair, with each slot 246, 248 dimensioned and arranged to be aligned with and receive respective ones of the hooked-ends of the forward-extending hooked arms 206, 208 of a second hanger component 202. Thus, unlike the guard component 214 that is shown to be pivotably suspended from a single hanger component 202 in FIG. 3, this example of the single guard component 230 is suspended from a combination of the separate hanger components 202 (two in this case).

As with the guard component 214, the guard component 230 may also include an elongate cylindrical pivot element 250 along a top edge thereof to further facilitate the pivoting ability of the guard component 230 relative to the first and second hanger components 202. When the elongate cylindrical pivot element 250 is present and the guard component 230 is engaged with the hanger components 202 as described above, the guard component 230 is pivotably suspended from a combination of the separate hanger components 202 by engagement of the elongate cylindrical pivot element 250 with the corresponding grooves 210, 212 in the forward-extending hooked arms 206, 208 of each of the first and second hanger components 202.

FIG. 5C depicts an example of a guard component 260 that is larger than the guard component 214 shown in FIG. 3 and in FIG. 5A, and is also larger than the guard component 230 shown in FIG. 5B. This example of the guard component 260 is intended for use with an ice storage bin that is larger than an ice storage bin with which the guard component 230 would be used, or with a refrigeration appliance or an ice-making refrigeration appliance that includes two ice storage bins of substantially equal width arranged side-by-side. For example, the guard component 260 may be used in conjunction with a refrigeration appliance or an ice-making refrigeration appliance of a standard 48 inch width.

The guard component 250 may include an upper portion 262 in the form of a substantially flat plate. In this example, a first ice-raking lower portion 264 and a second ice-raking lower portion 266 are separated by a notch 268 and extend forward and downward relative to a front face 270 of the upper portion 262 in a like or similar manner described above relative to the guard component 214.

This example of the guard component 260 also includes four slots, 272, 274, 276, 278 that pass through the upper portion 262 of the guard component 260, in a similar fashion to the slots 242, 244, 246, 248 of the guard component 230 of FIG. 5B. The slots 272, 274 of the guard component 260 form a first slot pair, with each slot 272, 274 dimensioned and arranged to be aligned with and receive respective ones of the hooked-ends of the forward-extending hooked arms 206, 208 of a first hanger component 202. The remaining slots 276, 278 similarly form a second slot pair, with each slot 276, 278 dimensioned and arranged to be aligned with and receive respective ones of the hooked-ends of the forward-extending hooked arms 206, 208 of a second hanger component 202. Thus, like the guard component 230 shown in FIG. 5B, this example of the single guard component 260 is also suspended from a combination of two separate hanger components 202.

As with the guard components 214, 230 the guard component 260 may also include an elongate cylindrical pivot element 280 along a top edge thereof to further facilitate the pivoting ability of the guard component 260 relative to the first and second hanger components 202. When the elongate cylindrical pivot element 280 is present and the guard component 260 is engaged with the first and second hanger components 202 as described above, the guard component 260 is pivotably suspended from a combination of the separate first and second hanger components 202 by engagement of the elongate cylindrical pivot element 280 with the corresponding grooves 210, 212 in the forward-extending hooked arms 206, 208 of each of the first and second hanger components 202.

Like the hanger component 202 and the guard component 214, the guard components 230, 260 can be manufactured from various materials, including without limitation, metal and plastic. In this example, the guard components 230, 260 are molded plastic components. Additionally, while the size and position of the slot 238 of the guard component 230 results in guard component ice-raking lower portions 234, 236 of substantially equal length, and while the size and position of the notch 268 of the guard component 260 results in guard component ice-raking lower portions 264, 266 of substantially equal length, it should be understood that either or both of the guard components 230, 260 can instead be configured with guard component ice-raking lower portions of dissimilar length. Such a configuration may be desirable, for example, to allow use of the guard components 230, 260 with a pair of ice storage bins of dissimilar width.

Figure 6:
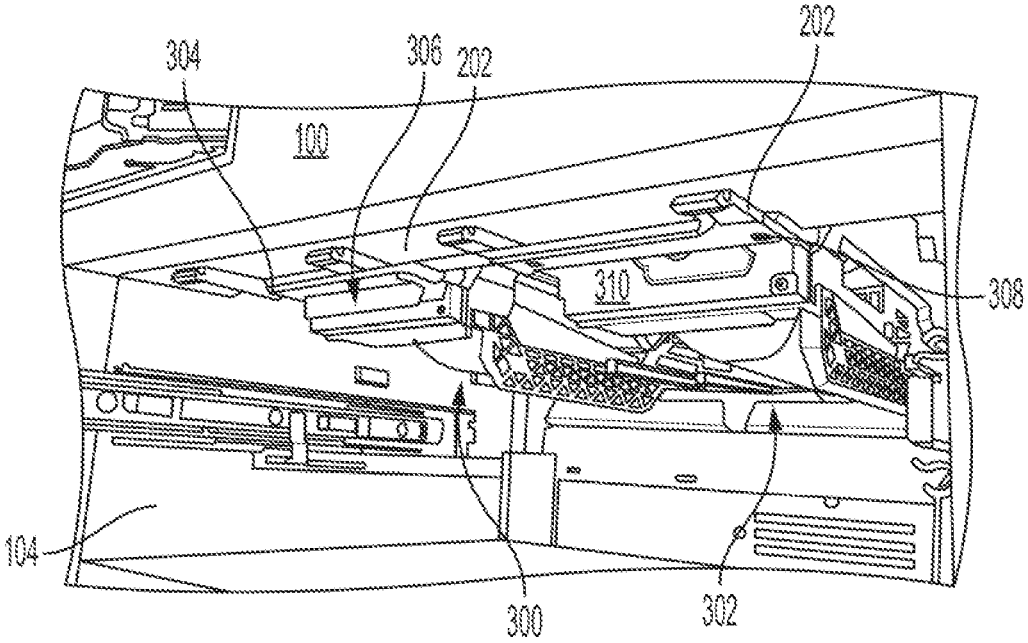
FIG. 6 shows a pair of hanger elements of a pivotable ice bin guard device installed to a refrigeration appliance according to one example of the present disclosure.

FIG. 6 shows two separate hanger components (i.e., a first/left and second/right hanger component), such as the hanger components 202 depicted in FIGS. 3-4, mounted within the freezer space 104 of the ice-making refrigeration appliance 100 of FIGS. 1-2. In this particular example, the hanger components 202 are respectively mounted forward of separate automatic ice maker components 300, 302, and to an upper wall or other cabinet element associated with the freezer space 104. In this particular example, the left hanger component 202 shares at least one mounting fastener 304 with a frame portion 306 of the automatic ice maker 300, and the right hanger component 202 shares at least one mounting fastener 308 with a frame portion 310 of the automatic ice maker 302.

Figure 7:
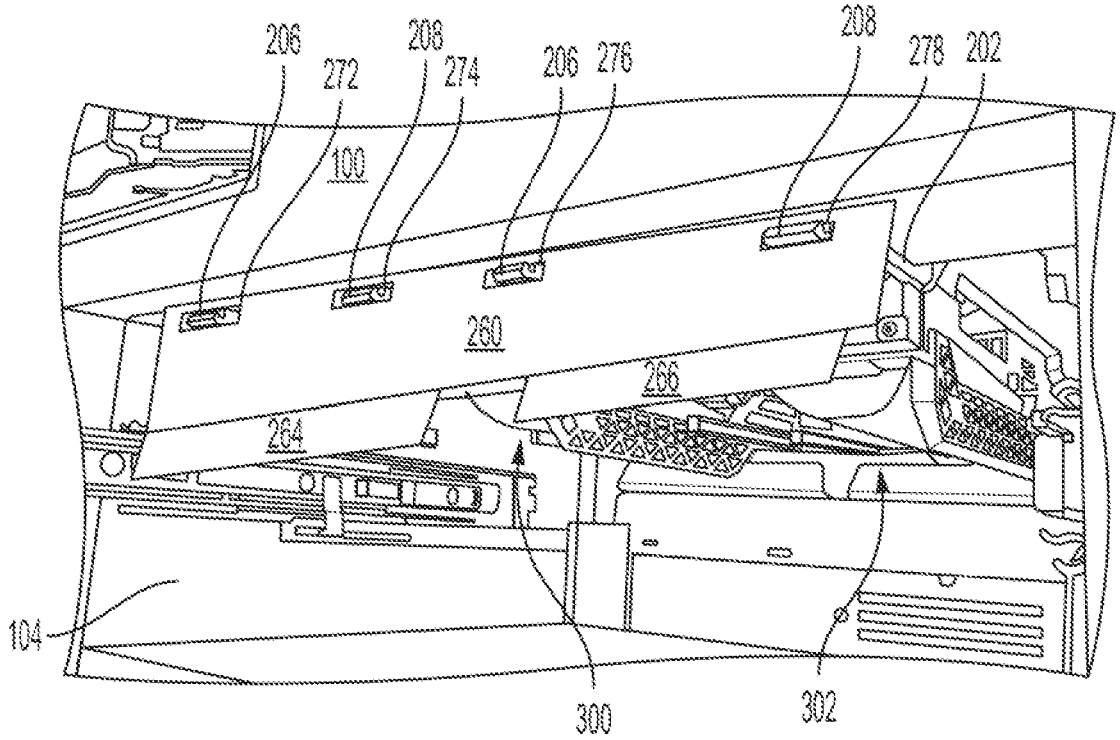
FIG. 7 depicts the guard component of FIG. 5C pivotably connected to the pair of hanger elements of FIG. 6.

FIG. 7 depicts the guard component 260 of FIG. 5C pivotably coupled to the hanger components 202 that are shown mounted to the ice-making refrigeration appliance 100 in FIG. 6 to form a pivotable ice bin guard device. As may be observed, and as previously described above, the hooked-ends of the forward-extending hooked arms 206, 208 of the left hanger component 202 are respectively engaged with the slots 272, 274 in the guard component 260, and the forward-extending hooked arms 206, 208 of the right hanger component 202 are respectively engaged with the slots 276, 278 in the guard component 260, which allows the guard component 260 to be pivotably suspended below the hanger component. The guard component 260 is preferably pivotable in both a forward and rearward direction while suspended from the hanger components 202.

Figure 8:
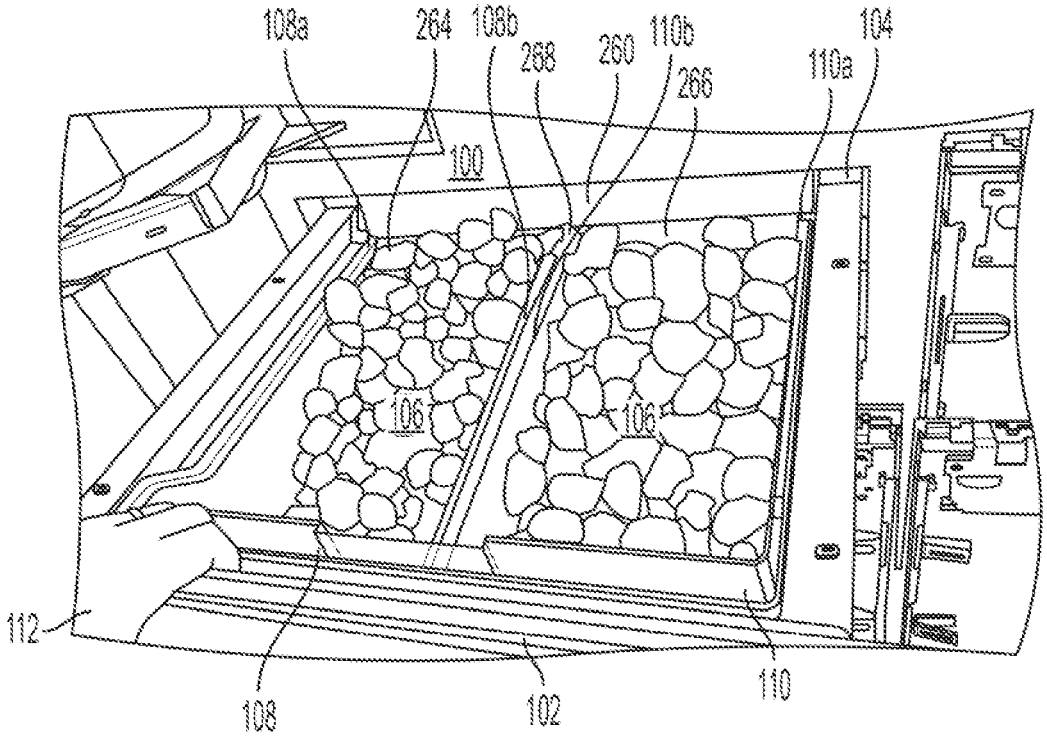
FIG. 8 shows the pivotable ice bin guard device of FIG. 7 in operation to prevent ice cubes from being inadvertently ejected from the rear of a pair of ice storage bins located in an ice drawer of a refrigerator appliance according to one example of the present disclosure.

Referring now to FIG. 8, a pivotable ice bin guard device comprising the hanger components 202 and the guard component 260 can be observed in operation to prevent ice cubes 106 from being ejected over the rear walls 108*a*, 110*a* of the ice storage bins 108, 110 of the ice-making refrigeration appliance 100. As shown, the guard component 260 is pivotably coupled to the hanger components 202 so as to be suspended below the hanger components 202 and above the ice storage bins 108, 110 and the drawer 102 within which the ice storage bins 108, 110 reside. The guard component 260 is also positioned so as to be substantially aligned with a stopping point of the rear walls 108*a*, 110*a* of the ice storage bins 108, 110 when the ice storage bins 108, 110 (and the drawer 102) are in the illustrated extended position relative to the ice-making refrigeration appliance 100 and the freezer space 104 located therein. Likewise, the notch 268 residing between the ice-raking lower portions 264, 266 of the guard component 260 accommodates adjacent side walls 108*b*, 110*b* of the two ice storage bins 108, 110.

Figure 9A:
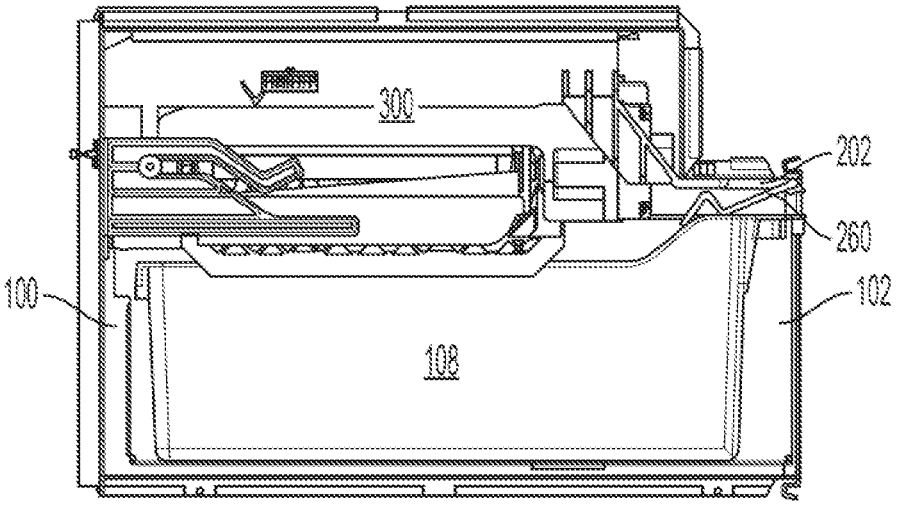
FIG. 9A illustrates the position of a guard component of a pivotable ice bin guard device when an associated ice bin is in a retracted position according to one example of the present disclosure.
Figure 9B:
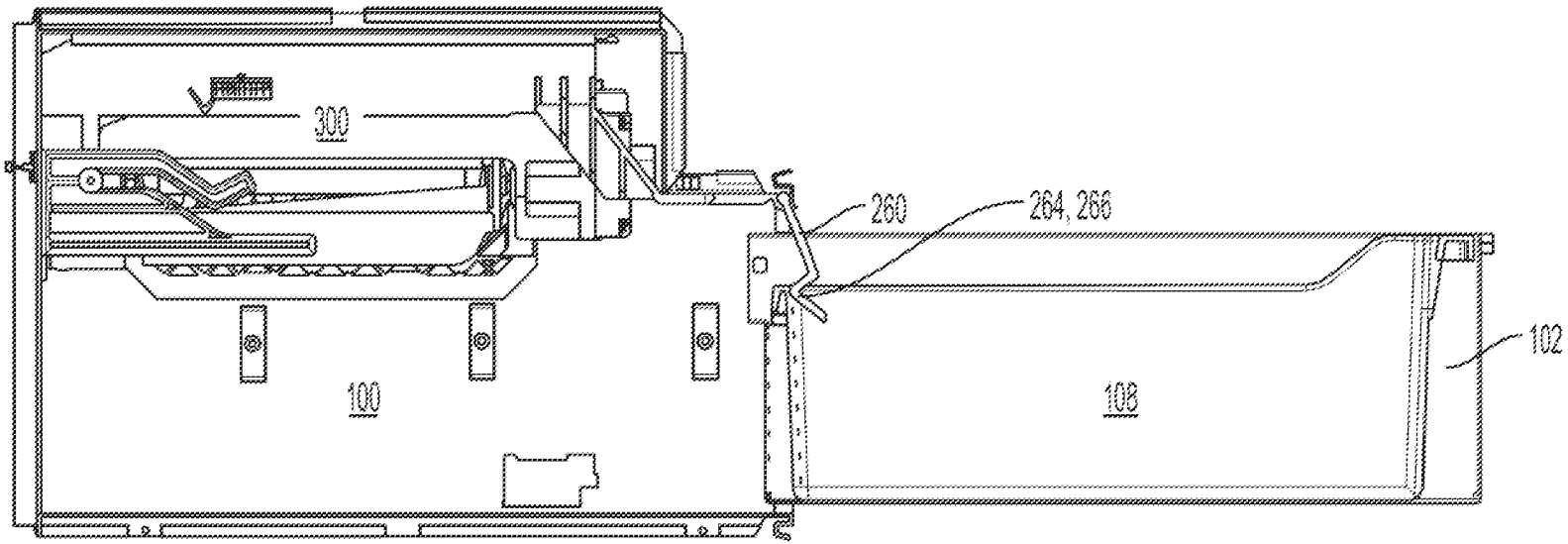
FIG. 9B illustrates the position of a guard component of a pivotable ice bin guard device when an associated ice bin is in an extended position according to one example of the present disclosure.

As represented in FIG. 8 and FIG. 9B, at least the ice-raking lower portions 264, 266 of the guard component 260 may engage with (e.g., overlap) the rear walls 108*a*, 110*a* of the ice storage bins 108, 110 when the ice storage bins 108, 110 and the drawer 102 are in the extended position. This helps the guard component 260 to effectively prevent ice from being ejected over the rear walls 108*a*, 110*a* of the ice storage bins 108, 110 and into a space behind the drawer 102 when, for example, the user 112 scoops the ice cubes 106 toward the rear of the ice storage bins 108, 110, or if the drawer 102 is extended too quickly and the ice cubes 106 resultantly slide rearward.

As illustrated most clearly in FIGS. 9A-9B, the guard component 260 of pivotable ice bin guard device 200 can pivot forward or backward relative to the ice-making refrigeration appliance 100 as needed when the drawer 102 and the ice storage bins 108, 110 located therein are being extended from or retracted into the freezer space 104. For example, as depicted in FIG. 9A, the guard component 260 can pivot rearward and upward into a stored position when the drawer 102 and the ice storage bins 108, 110 are in a retracted (closed) position. The guard component 260 can also pivot forward and upward during the process of extending the drawer 102 and the ice storage bins 108, 110 from the retracted position shown in FIG. 9A to the extended (open) position shown in FIG. 9B, which allows the guard component 260 to ride over top of the ice cubes 106 in the ice storage bins 108, 110. Further, during the process of retracting (closing) the drawer 102 and the ice storage bins 108, 110 into the freezer space 104 from an extended position, the forward angle of the ice-raking lower portions 264, 266 of the guard component 260 can help the guard component 260 rake ice cubes 106 toward a front portion of the storage bins 108, 110, while the guard component can also still pivot rearward and upward as necessary to prevent excessive interference between the guard component and piled ice cubes from preventing closure of the drawer 102. In at least one example, the guard component 260 can also be associated with a stop element (not shown) that limits pivoting of the guard component 260 in a rearward direction, which may enhance the ability of the guard component 260 to rake the ice cubes 106 toward a front of the ice storage bins 108, 110 while the drawer 102 is being retracted into the freezer space 104.

Figure 10:
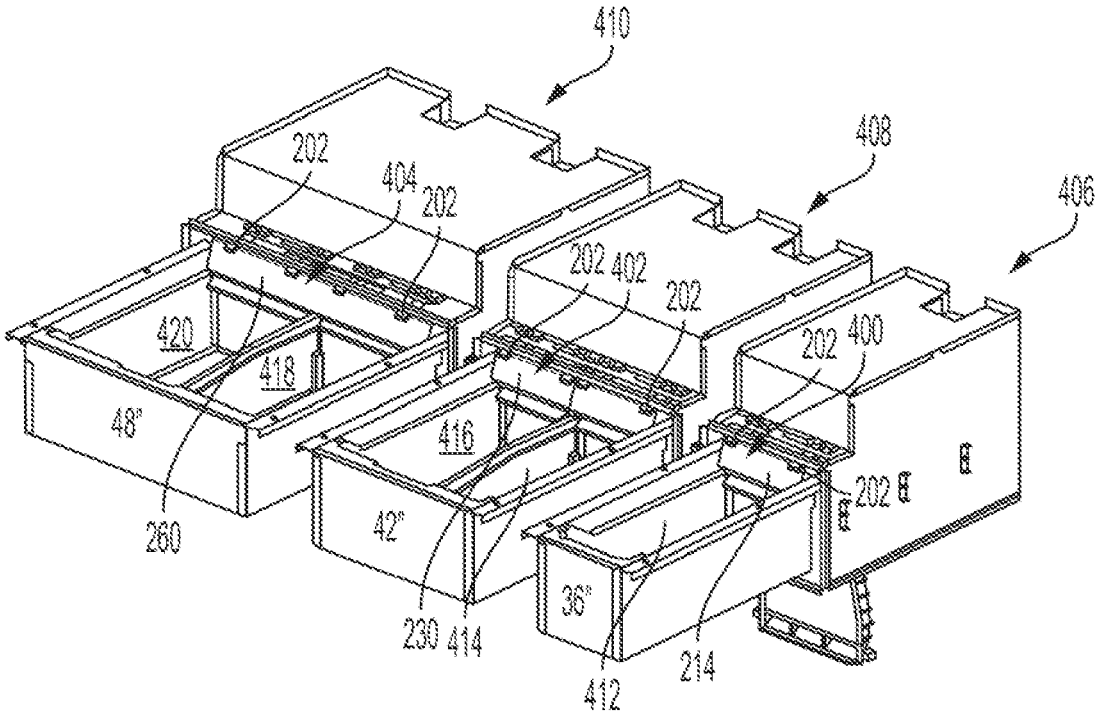
FIG. 10 represents pivotable ice bin guard devices associated with different sizes of refrigeration appliance ice drawers according to examples of the present disclosure.

FIG. 10 illustrates how pivotable ice bin guard devices according to examples of the present disclosure can be used with several different sizes of refrigeration appliance (e.g., ice) drawers. Particularly, FIG. 10 shows three non-limiting examples of pivotable ice bin guard devices 400, 402, 404 that are respectively installed to a 36 inch wide refrigeration appliance 406, a 42 inch wide refrigeration appliance 408, and a 48 inch wide refrigeration appliance 410, only portions of which are shown for reasons of clarity in the illustration. Any one or all of the refrigeration appliances 406, 408, 410 can be an ice-making refrigeration appliance.

In the examples shown, the pivotable ice bin guard device 400 installed to the 36 inch wide refrigeration appliance 406, may be comprised, for example, of the hanger component 202 of FIG. 4 mounted within a freezer space of the refrigeration appliance 406, and the guard component 214 shown in FIG. 3 and in FIG. 5A pivotably suspended from the hanger component 202 above an ice storage bin 412 of the refrigeration appliance 406. Similarly, the pivotable ice bin guard device 402 installed to the 42 inch wide refrigeration appliance 408, may be comprised, for example, of a pair of the hanger components 202 shown in FIG. 4 mounted within a freezer space of the refrigeration appliance 408, and the guard component 230 shown in FIG. 5B pivotably suspended from the combination of the two hanger components 202 above a pair of adjacent ice storage bins 414, 416 of the refrigeration appliance 408. Likewise, the pivotable ice bin guard device 404 installed to the 48 inch wide refrigeration appliance 410, may be comprised, for example, of a pair of the hanger components 202 shown in FIG. 4 mounted within a freezer space of the refrigeration appliance 410, and the guard component 260 shown in FIG. 5C pivotably suspended from the combination of the two hanger components 202 above pair of adjacent ice storage bins 418, 420 of the refrigeration appliance 410.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A pivotable ice bin guard device for a refrigeration appliance having at least one extendable ice storage bin, comprising:

a hanger component for mounting to a cabinet of the refrigeration appliance and above the at least one extendable ice storage bin; and a guard component pivotably coupled to the hanger component so as to be suspended below the hanger component and substantially aligned with a stopping point of a rear wall of the at least one extendable ice storage bin when the at least one extendable ice storage bin is in an extended position relative to the refrigeration appliance;

wherein the guard component will serve as a barrier to prevent ice cubes from being ejected over the rear wall of the at least one extendable ice storage bin when the at least one extendable ice storage bin is in the extended position.

2. The pivotable ice bin guard device of claim 1, wherein the at least one extendable ice storage bin is an ice storage bin that resides in and moves with a drawer that is extendable and retractable relative to the refrigeration appliance.

3. The pivotable ice bin guard device of claim 1, wherein the hanger component includes forward-extending hooked arms and the guard component is pivotably suspended from the hanger component by engagement of the hooked arms of the hanger component with slots in the guard component.

4. The pivotable ice bin guard device of claim 3, wherein the guard component includes an elongate cylindrical pivot element along a top edge thereof, and the guard component is pivotably suspended from the hanger component by engagement of the elongate cylindrical pivot element with corresponding grooves in the forward-extending hooked arms of the hanger component.

5. The pivotable ice bin guard device of claim 1, wherein the guard component is pivotable in both a forward and rearward direction while suspended from the hanger component.

6. The pivotable ice bin guard device of claim 1, wherein the guard component includes an upper portion in a form of a substantially flat plate, and one or more ice-raking lower portions that extend forward and downward relative to a front face of the upper portion.

7. The pivotable ice bin guard device of claim 6, wherein the one or more ice-raking lower portions of the guard component extend forward and downward at an obtuse angle relative to the front face of the upper portion.

8. A refrigeration appliance, comprising:

a cabinet, the cabinet defining a freezer space;

a drawer that is movable between an extended position that is substantially outside of the freezer space and a retracted position that is within the freezer space;

at least one ice storage bin residing in the drawer;

a pivotable ice bin guard device residing within the freezer space and comprising:

a hanger component mounted to the cabinet of the refrigeration appliance, within the freezer space of the refrigeration appliance, and at a location above the drawer and the at least one ice storage bin; and a guard component pivotably coupled to the hanger component, the guard component suspended between the hanger component and the at least one ice storage bin and substantially aligned with a rear wall of the at least one ice storage bin when the drawer is in the extended position;

wherein the guard component forms a barrier to prevent ice cubes from being ejected over the rear wall of the at least one ice storage bin when the drawer is in the extended position.

9. The refrigeration appliance of claim 8, further comprising an automatic ice maker located in the freezer space, the automatic ice maker including an ice cube producing component that overlies the at least one ice storage bin when the drawer is in the retracted position.

10. The refrigeration appliance of claim 9, wherein the hanger component shares at least one mounting fastener with a frame portion of the automatic ice maker.

11. The refrigeration appliance of claim 8, wherein the hanger component includes forward-extending hooked arms and the guard component is pivotably suspended from the hanger component by engagement between the hooked arms of the hanger component and slots in the guard component.

12. The refrigeration appliance of claim 8, wherein a lower portion of the guard component is engaged with the rear wall of the at least one ice storage bin when the drawer is in the extended position.

13. The refrigeration appliance of claim 8, wherein:

two ice storage bins reside in the drawer and are arranged side-by-side;

a separate hanger component is mounted above each ice storage bin;

a single guard component is suspended from a combination of the separate hanger components and forms a barrier to prevent ice cubes from being ejected over rear walls of both of the ice storage bins when the drawer is in the extended position; and the single guard component includes a notch that accommodates adjacent side walls of the two ice storage bins.

14. An ice-making refrigeration appliance, comprising:

a cabinet, the cabinet defining a freezer space;

a drawer that is movable between an extended position that is substantially outside of the freezer space and a retracted position that is within the freezer space;

an automatic ice maker located in the freezer space, the automatic ice maker including an ice cube producing component and at least one ice storage bin that resides in the drawer and is located beneath the ice cube producing component to collect ice cubes when the drawer is in the retracted position;

a pivotable ice bin guard device residing within the freezer space and comprising:

a hanger component mounted to the cabinet of the ice-making refrigeration appliance, within the freezer space of the ice-making refrigeration appliance, and at a location forward of the ice cube producing component of the automatic ice maker and above the drawer; and a guard component pivotably coupled to the hanger component, the guard component pivotably suspended between the hanger component and the at least one ice storage bin and substantially aligned with a rear wall of the at least one ice storage bin when the drawer is in the extended position;

wherein the guard component forms a barrier to prevent ice cubes from being ejected over the rear wall of the at least one ice storage bin when the drawer is in the extended position.

15. The ice-making refrigeration appliance of claim 14, wherein the hanger component shares at least one mounting fastener with a frame portion of the automatic ice maker.

16. The ice-making refrigeration appliance of claim 14, wherein the hanger component includes forward-extending hooked arms and the guard component is pivotably suspended from the hanger component by engagement between the hooked arms of the hanger component and slots in the guard component.

17. The ice-making refrigeration appliance of claim 14, wherein a lower portion of the guard component is engaged with the rear wall of the at least one ice storage bin when the drawer is in the extended position.

18. The ice-making refrigeration appliance of claim 14, wherein:

two ice storage bins reside in the drawer and are arranged side-by-side;

a separate hanger component is mounted above each ice storage bin;

a single guard component is suspended from a combination of the separate hanger components and forms a barrier to prevent ice cubes from being ejected over rear walls of both of the ice storage bins when the drawer is in the extended position; and the single guard component includes a notch that accommodates adjacent side walls of the two ice storage bins.

* * * * *